US005377883A

United States Patent [19]

Melton et al.

[11] Patent Number: 5,377,883

[45] Date of Patent: Jan. 3, 1995

[54] NECKTIE INSERT

[75] Inventors: Guy Melton; Raymond Fleeman, both of Wilmington, N.C.

[73] Assignee: Remington Apparel Co., Inc., Wilmington, N.C.

[21] Appl. No.: 169,367

[22] Filed: Dec. 20, 1993

[51] Int. Cl.[6] ..... D06C 15/00; B65D 85/18

[52] U.S. Cl. ..... 223/82; 223/81; 223/84; 206/295

[58] Field of Search ..... 223/82, 81, 84, 52; 206/292, 293, 294, 295, 296, 297; 2/137, 145

[56] References Cited

U.S. PATENT DOCUMENTS

| | | | |
|---|---|---|---|
| 701,942 | 6/1902 | Runtz | 206/297 |
| 1,391,444 | 9/1921 | Atkocaitis | 223/82 |
| 1,720,679 | 7/1929 | Karn | 206/295 |
| 1,757,622 | 5/1930 | Fitzgerald | 223/82 |
| 1,777,790 | 10/1930 | Figg | 223/82 |
| 2,142,618 | 1/1939 | Schreter | 223/82 |
| 2,493,252 | 1/1950 | Langley | 223/82 |
| 2,555,136 | 5/1951 | Kaiser | 223/82 |
| 2,580,914 | 1/1952 | Hirsch | 223/82 |
| 3,880,334 | 4/1975 | Haas | 223/82 |

FOREIGN PATENT DOCUMENTS

| | | | |
|---|---|---|---|
| 1108947 | 1/1956 | France | 223/82 |
| 548702 | 9/1956 | Italy | 223/82 |
| 25737 | of 1904 | United Kingdom | 223/83 |
| 483350 | 4/1938 | United Kingdom | 223/82 |

*Primary Examiner*—Clifford D. Crowder
*Assistant Examiner*—Bibhu Mohanty
*Attorney, Agent, or Firm*— Stoltz

[57] ABSTRACT

By providing an elongated, substantially continuous body portion having a size and shape corresponding to a major length of conventional neckties, with said body portion incorporating a plurality of apertures formed therein, a necktie insert for promoting rapid, easy and efficient drying of a washed necktie is achieved. In the preferred embodiment, the necktie insert comprises two elongated arm members, formed by a centrally disposed elongated slit, which causes the arm members to be outwardly biased. In this way, a spreading force is exerted on the necktie by the insert, thereby causing the necktie to dry substantially wrinkle free.

13 Claims, 1 Drawing Sheet

NECKTIE INSERT

TECHNICAL FIELD

This invention relates to necktie cleaning and drying apparatus and, more particularly, to an insert for use in shaping and drying a necktie after washing.

BACKGROUND ART

The wearing of neckties by both men and women has been extremely popular for decades and continues to increase in popularity. As a result, one ever increasing problem associated with the wearing of neckties is the need for having the necktie cleaned or laundered in order to remove any dirt or stains as well as to keep the necktie looking new and vibrant.

In view of the inherent difficulty generally encountered in home laundering of neckties, due to their construction, most individuals have found it necessary to have neckties dry cleaned and pressed in order to maintain with the desired visual appearance. However, the dry cleaning of neckties has become increasingly expensive and alternate cleaning methods are continuously being sought.

The principal alternative to dry cleaning of neckties is home laundering. However, substantial difficulty has been encountered in being able to properly launder and press a necktie and maintain the same crisp, pressed visual appearance a necktie possesses when originally purchased, or when dry cleaned and pressed. In an attempt to satisfy this need, several necktie forms have been developed over the years.

Most prior art structures merely provide a necktie insert for use during the display of the necktie prior to purchase by the consumer. Other prior art constructions teach necktie shapers which are specifically constructed for stretching the necktie in the area of the knot, in order to eliminate the wrinkles normally resulting after the tie has been worn on several occasions. Further prior art systems have been constructed to be used as necktie inserts forms for assisting in ironing the necktie in an attempt to obtain its original appearance, while also providing a surface upon which the necktie can be manually scrubbed with a scrub brush.

In spite of the various prior art efforts, no prior art system has been developed which is capable of being quickly and easily employed by a consumer to assure complete, trouble-free drying of a necktie. In particular, no prior art construction exists for drying a necktie which is washed in a conventional washing machine, and provides both complete drying as well as wrinkle removal and shaping of the necktie.

Consequently, it is a principal object of the present invention to provide a necktie drying insert which is capable of being quickly and easily used by the consumer for assisting in drying of a washed necktie.

Another object of the present invention is to provide a necktie drying insert having the characteristic features described above which is capable of providing trouble-free complete drying of a washed necktie as well as shaping the necktie during the drying process.

Another object of the present invention is to provide a necktie drying insert having the characteristic features described above which also is capable of functioning to substantially remove all wrinkles from the necktie.

Other and more specific objects will in part be obvious and will in part appear hereinafter.

SUMMARY OF THE INVENTION

The present invention overcomes the prior art drawbacks and provides an easily employable necktie drying insert which is capable of providing complete drying of a necktie, after washing, while also eliminating substantially all wrinkles during the drying process. This previously unattainable goal is now achieved by employing a uniquely constructed necktie insert which is easily mounted between the front and rear panels of the necktie for cooperative association therewith after the necktie has been washed.

In order to attain the desired results, the necktie drying insert of this invention incorporates an elongated, substantially continuous length of flexible material having an overall size and shape substantially identical to the size and shape of most neckties. Preferably, the insert is sold with a necktie and comprises a size and shape consistent with the particular necktie with which the drying insert is associated.

In addition to comprising a size and shape consistent with the size and shape of the necktie, the necktie drying insert of the present invention incorporates a plurality of apertures formed throughout the entire length thereof in order to assist in providing and establishing air flow passageways between the tie and the insert. In this way, drying of the tie is advanced and achieved most expeditiously.

Furthermore, the necktie drying insert of the present invention incorporates an elongated longitudinally extending slit substantially centrally disposed in the necktie insert, extending from the narrowest end of the insert and terminating several inches away from the base of the insert. By incorporating a centrally disposed longitudinally extending slit, the necktie drying insert of the present invention comprises two elongated separate arm portions, each of which are generally biased outwardly from each other. As a result, when the necktie insert is positioned securely within the length of the necktie, the biasing action of the two longitudinally extending arm portions causes the arm members to continuously exert an outwardly biasing force on the edges of the necktie so as to stretch the necktie and eliminate any wrinkles that might otherwise be created during the drying process.

In the preferred embodiment, each of the apertures formed in the drying insert comprises a diameter ranging between about 1/16 inches and ¼ inches. In addition, the apertures are distributed over the entire surface of the insert in order to achieve between about one and three apertures per square inch. In this way, the desired air flow is attained and complete drying of the necktie is realized.

By employing the necktie drying insert of the present invention, an easily employed, highly efficient and dependable construction is attained which can be easily employed by any consumer after washing of a necktie for providing a substantially wrinkle-free completely dry necktie. By constructing an insert with a plurality of apertures in combination with the elongated longitudinally extending slit, a unique construction is realized which eliminates all of the prior art objections and attains a necktie drying insert capable of providing results which have been previously been unattainable.

The invention accordingly comprises the features of construction, combination of elements and arrangement of parts which will be exemplified in the construction hereinafter set forth and the scope of the invention will be indicated in the claims.

THE DRAWINGS

For a fuller understanding of the nature and objects of the present invention, reference should be had to the following detailed description taken in connection with the accompanying drawings in which:

FIG. 1 is a plan view of the necktie drying insert of the present invention; and FIG. 2 is a plan view, partially broken away, showing the necktie drying insert of the present invention positioned within a conventional necktie.

DETAILED DESCRIPTION

Figure 1:
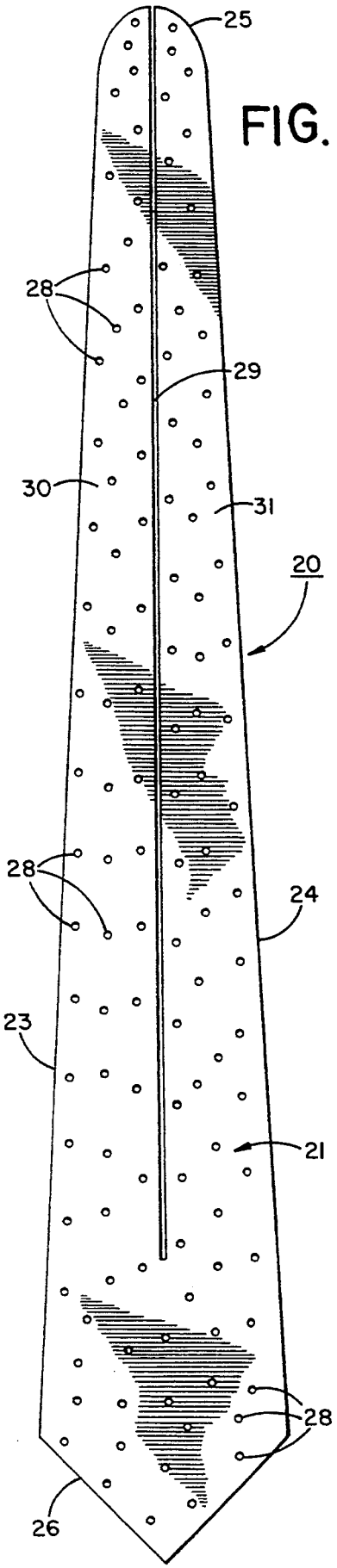
Figure 2:
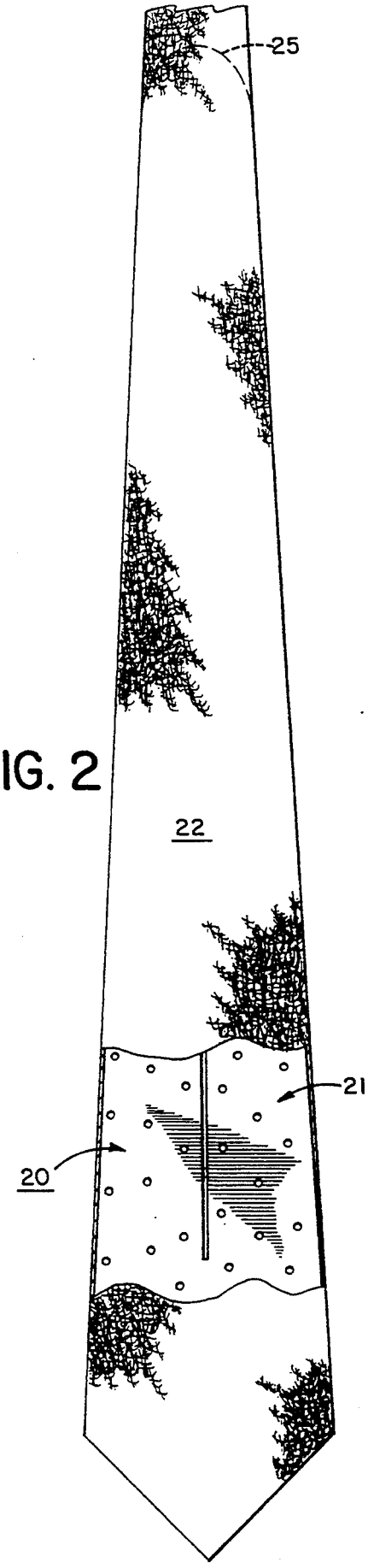

In FIGS. 1 and 2, the preferred embodiment of the necktie drying insert 20 of the present invention is fully detailed. In this preferred embodiment, necktie drying insert 20 comprises an elongated, substantially continuous body portion 21, having an overall size and shape substantially equivalent to a major length of necktie 22 with which insert 20 is constructed to cooperate. In general, for most conventional neckties, body 21 of necktie drying insert 20 preferably comprises an overall length ranging between about twenty-two and twenty-five inches.

Body portion 21 of necktie drying insert 20 preferably comprises an overall size and shape consistent with the size and shape of necktie 22 for which necktie drying insert 20 is constructed to be cooperatively associated. As shown in FIG. 2, when necktie drying insert 20 is positioned in cooperative, interengaged association with necktie 22, insert 20 is longitudinally advanced into a major length of necktie 22, between the front panel and the rear panel of necktie 22. In this way, as further detailed below, insert 20 provides the desired rigidity, outward biasing and air flow passageways to assure complete and efficient wrinkle-free drying of necktie 22.

In the preferred embodiment, body portion 21 of necktie drying insert 20 comprises side edges 23 and 24 and end portions 25 and 26. As clearly depicted in FIG. 1, side edges 23 and 24 are preferably constructed in a tapering configuration, as the side edges extend away from terminating end 26, consistent with the shape of tie 22. In the typical construction, end 26 comprises a substantially "V" shape which is constructed to match the shape of the end of tie 22 with which insert 20 is associated. In general, end 26 is constructed with each of the legs thereof comprising an overall length ranging between about 2 inches and 3.5 inches, with an included angle ranging between about 87° and 90°.

As clearly shown in FIGS. 1 and 2, end 25 of necktie drying insert 20 comprises a smoothly curved arcuate construction. Although various arcuate curvatures may be employed, without departing from the scope of this invention, it has been found that two separate arcs are preferred in order to attain the desired continuous rounded construction. In this way, ease of insertion of insert 20 into tie 22 is attained with insert 22 being easily advanced longitudinally through tie 22 to the desired, fully engaged position, as depicted in FIG. 2.

In order to provide the desired drying and shaping functions inherent in the present invention, necktie drying insert 20 comprises a plurality of holes 28 formed in body portion 21 throughout the entire length thereof. In addition, body portion 21 incorporates a centrally disposed, longitudinally extending, elongated slit 29 which forms arm portions 30 and 31 in body portion 21.

By employing this construction, arm portions 30 and 31 form independent flexible members, each of which are continuously maintained with an outwardly biasing force, when necktie drying insert 20 is positioned within a necktie 22. As a result, arm portions 30 and 31 move in opposite directions, causing necktie 22 to be continuously maintained in a fully stretched configuration during the drying process.

In the preferred embodiment, apertures 28 are formed throughout body 21 of necktie insert 20 in a substantially, uniformly dispersed configuration. In the preferred construction, apertures 28 are formed with a diameter ranging between about 1/16 inches and ¼ inches. In addition, in order to provide the desired uniform, consistent air flow through necktie 22 and insert 20 when necktie 22 is drying, it is preferred that between about one and three holes are formed in each square inch of insert 20. By employing this construction, the desired free flow of air through necktie 22 and insert 20 is provided and trouble-free and efficient drying of the necktie is realized.

In order to form flexible arm portions 30 and 31 to attain the desired outwardly biasing force for drying necktie 22 without wrinkles, as well as enabling insert 20 to be quickly and easily longitudinally advanced into necktie 22 for secure positioning therein, insert 20 is formed with elongated, longitudinally extending slit 29. Preferably, slit 29 is formed with an overall length ranging between about 18 inches and 20 inches. In this regard, the preferred length for elongated slit 29 is 19.25 inches.

In addition, in order to assure that arm portions 30 and 31 provide the desired outwardly biasing force for enhancing and establishing a wrinkle-free tie 22, elongated slit 29 is constructed with a width ranging between about 1/32 inches and 3/32 inches. In the preferred embodiment, the slit width is 1/16 inches.

As discussed above, end 25 is preferably constructed with a substantially continuous rounded configuration. In order to achieve the desired result, any desired arcuate curve can be employed to attain the smoothly curved, rounded construction for end 25. As discussed above, the preferred construction uses two cooperating, smoothly blended arcuate curvatures for achieving the rounded portion of each arm member 30 and 31 at end 25.

In general, any desired rounded construction can be employed for end 25 without departing from the scope of this invention. However, as is apparent from this detailed disclosure, end 25 is constructed to be snag free, in order to assure that insert 20 can be easily advanced longitudinally into tie 22 without catching or abutting any interior portions of tie 22. By constructing end 25 with a smooth, continuous, rounded curvature, unwanted sharp corners or ends are avoided, and trouble-free axial advance of end 25 into tie 22 is provided with the desired, fully interengaged, position being easily attained.

In order to further enhance the usability and efficacy of necktie insert 20) of the present invention, body 21 is formed from a plastic sheet having a medium resiliency. In this way, sufficient flexibility is attained, while inherent strength and rigidity is also provided for performing the desired functions. In order to assure that the plastic sheet employed for body 21 of necktie insert 20 comprises sufficient inherent strength and rigidity, the thickness of body 21 preferably ranges between about 0.015 inches and 0.030 inches, with the optimum thickness being 0.020 inches.

By employing the teaching of the present invention, a necktie drying insert is attained which is capable of being easily and quickly advanced into necktie 22 after necktie 22 has been washed, for assuring that necktie 22 drys thoroughly and completely without any wrinkles. In order to employ necktie drying insert 20, insert 20 is merely longitudinally advanced into the wider end portion of necktie 22, until insert 20 is fully interengaged within necktie 22. With insert 20 constructed for mating interengagement with a particular necktie, the axial, longitudinal advance of insert 20 into the desired necktie 22 is quickly and easily achieved with arms 30 and 31 providing the desired outward biasing force to assure that necktie 22 is maintained taut for eliminating any wrinkles therefrom. In addition, the plurality of apertures 28 formed in necktie insert 20 assures that the desired free flow of air is attained through necktie 22 and insert 20, thereby assuring quick, easy, and rapid drying of necktie 22 in an efficient manner.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A necktie insert member for cooperating mounted engagement between the front panel and rear panel of a necktie for assisting in drying the necktie after washing, said necktie insert member comprising A. an elongated, substantially continuous unitary body portion formed from a single sheet of material and having
  a. a size and shape consistent with the size and shape of the necktie with which the insert member cooperates,
  b. a first narrow end, and
  c. a second wide end;

B. a plurality of apertures formed throughout the body portion providing air flow passageways;

C. an elongated, substantially centrally disposed slit,
  a. formed in the body portion
  b. extending longitudinally from the first narrow end through a major length of said body portion; and
  c. establishing a pair of independent, elongated arm members on opposed sides thereof; and D. a pair of independent, elongated arm members formed in the body portion by said elongated slit, with each arm member
  a. comprising a free terminating end formed at the first narrow end thereof, and
  b. being flexibly movable independently of the other arm member to assure ease of insertion into the necktie when desired;

whereby a necktie insert member is attained which is capable of being quickly and easily advanced longitudinally into a substantial length of the necktie for secure abutting interengagement with the necktie, assisting in providing efficient, rapid drying of the necktie after washing.

2. The necktie insert member defined in claim 1 wherein said arm members are further defined as being normally biased away from each other, for exerting a biasing force on the necktie when the insert member is fully interengaged therewith, thereby assuring that the necktie dries substantially wrinkle free.

3. The necktie insert member defined in claim 2 wherein said elongated, substantially centrally disposed slit is further defined as comprising an overall length ranging between about 18 inches and 20 inches and a width ranging between about 1/32 inches and 3/32 inches.

4. The necktie insert member defined in claim 3, wherein said elongated slit is further defined as comprising an overall length of 19.25 inches and a width of 1/16 inches.

5. The necktie insert member defined in claim 1, wherein each of said apertures is further defined as comprising a substantially circular shape with a diameter ranging between about 1/16 inches and ¼ inches.

6. The necktie insert member defined in claim 5, wherein said apertures are further defined as being formed throughout the body portion at a rate of between about 1 and 3 apertures for each square inch thereof.

7. The necktie insert member defined in claim 6, wherein the diameter of each aperture is further defined as comprising ⅛ inches.

8. The necktie insert member defined in claim 1, wherein said first narrow end is further defined as comprising a substantially continuous, arcuate configuration.

9. The necktie insert member defined in claim 8, wherein said second, wide end is further defined as comprising a substantially "V"-shaped configuration, conforming with the overall configuration of the necktie for which the insert is constructed to cooperate.

10. The necktie insert member defined in claim 9, wherein each of the arm members is further defined as comprising a substantially arcuate terminating end formed at the first end of said body portion, to assure ease of insertion of the insert into the desired necktie without snagging.

11. The necktie insert member defined in claim 1, wherein said body portion is further defined as comprising an overall length ranging between about 22 inches and 25 inches, and is formed from plastic sheet material.

12. The necktie insert member defined in claim 11, wherein said body portion is further defined as comprising a thickness ranging between about 0.015 inches and 0.030 inches.

13. The necktie insert member defined in claim 12, wherein said body portion is further defined as comprising a thickness of 0.020 inches.

* * * * *